US011712789B1

(12) United States Patent
McMahill

(10) Patent No.: US 11,712,789 B1
(45) Date of Patent: Aug. 1, 2023

(54) VALVE TOOL

(71) Applicant: Scott McMahill, Louisville, TN (US)

(72) Inventor: Scott McMahill, Louisville, TN (US)

( * ) Notice: Subject to any disclaimer, the term of this patent is extended or adjusted under 35 U.S.C. 154(b) by 278 days.

(21) Appl. No.: 17/151,708

(22) Filed: Jan. 19, 2021

Related U.S. Application Data

(60) Provisional application No. 62/961,732, filed on Jan. 16, 2020.

(51) Int. Cl.
*B25B 27/26* (2006.01)

(52) U.S. Cl.
CPC ..... *B25B 27/26* (2013.01)

(58) Field of Classification Search
CPC ..... B25B 27/26
See application file for complete search history.

(56) References Cited

U.S. PATENT DOCUMENTS 1,510,542 A * 10/1924 Burrows ..... B25B 27/26 29/219
1,621,237 A 3/1927 Davis
1,739,391 A * 12/1929 Essen ..... B25B 27/26 29/219
1,913,084 A * 6/1933 Kulp ..... B25B 27/26 29/219
1,982,838 A * 12/1934 Sunnen ..... B25B 27/26 29/219
2,601,639 A * 6/1952 Schneider ..... B25B 27/26 29/217
3,010,192 A * 11/1961 Rufer ..... B25B 27/26 29/217
3,814,382 A 6/1974 Castoe
3,977,064 A 8/1976 Mote et al.
4,376,331 A * 3/1983 Clark ..... B25B 27/26 269/283
4,780,941 A 11/1988 Tucker
4,976,280 A * 12/1990 Lagana ..... B25B 27/26 29/217
5,052,091 A * 10/1991 Bryan ..... B25B 27/26 29/215
5,371,932 A 12/1994 Bryan et al.
5,507,470 A 4/1996 Amstutz
5,519,928 A 5/1996 Hardy
5,680,686 A 10/1997 Bosche et al.
5,713,117 A * 2/1998 Bliss ..... B25B 27/023 29/257
6,615,467 B1 * 9/2003 Richards ..... B30B 1/12 29/213.1
2007/0017078 A1 * 1/2007 Kolano ..... B25B 27/26 29/219
2009/0013514 A1 1/2009 Uzun
2012/0102702 A1 5/2012 Mitchell

* cited by examiner

*Primary Examiner* — Seahee Hong
(74) *Attorney, Agent, or Firm* — Robinson IP Law, PLLC

(57) ABSTRACT

A valve tool for servicing a multiport valve having a handle and further having a spring located between a rotor and a lid of the multiport valve, the valve tool comprising: an upper support portion including a cutout shaped to receive at least a portion of the handle of the multiport valve therethrough; an opposing lower support portion; a press located on one of the upper support portion and lower support portion, the press shaped to contact one of the rotor and lid of the multiport valve. The press urges the rotor and the lid of the multiport valve together to compress the spring between the rotor and the lid of the multiport valve.

13 Claims, 12 Drawing Sheets

VALVE TOOL

CROSS-REFERENCE TO RELATED APPLICATION

This application claims priority to and is a non-provisional of U.S. Provisional Patent Application No. 62/961,732 for a Valve Tool filed on Jan. 16, 2020, the contents of which are incorporated herein by reference in its entirety.

FIELD

This disclosure relates to the field of valves and tools for servicing valves. More particularly, this disclosure relates to a valve tool for servicing of multi-port valves having handles located thereon.

BACKGROUND

Valves typically include multiple seals, o-rings, and other components that may wear out and require replacement over a life of a valve. For example, multi-port valves used with swimming pools include o-rings and seals that must be replaced to ensure continued proper operation of the valve.

Replacement of components of a valve may be difficult, particularly if the valve includes one or more springs that must be compressed for disassembly of the valve. For example, on a multi-port valve, a spring of the valve must be compressed such that a pin securing a handle of the valve may be removed and the valve may be subsequently disassembled. The spring may be substantially stiff, and compression of the valve is typically difficult and requires stabilization of the valve while also compressing the valve.

What is needed, therefore, is a valve tool for compressing a valve that includes a spring to aid in disassembly and service of the valve.

SUMMARY

The above and other needs are met by a valve tool for compressing a valve that includes a spring to aid in disassembly and service of the valve. In a first aspect, a valve tool for servicing a multiport valve having a handle and further having a spring located between a rotor and a lid of the multiport valve, the valve tool including: an upper support portion including a cutout shaped to receive at least a portion of the handle of the multiport valve therethrough; an opposing lower support portion; and a press located on one of the upper support portion and lower support portion, the press shaped to contact one of the rotor and lid of the multiport valve. The press urges the rotor and the lid of the multiport valve together to compress the spring between the rotor and the lid of the multiport valve.

In one embodiment, the press is located on the opposing lower support portion. In another embodiment, the press further includes a handle and a press end movable relative to the opposing lower portion of the valve tool, wherein the press end is shaped to contact the rotor of the multiport valve to urge the rotor towards the lid to compress the spring of the multiport valve.

In yet another embodiment, the valve tool further includes one or more posts extending between the upper support portion and the lower support portion. In one embodiment, the one or more posts have a length such that the upper support portion is spaced apart from the lower support portion such that the multiport valve may fit between the upper support portion and the lower support portion.

In another embodiment, the upper support portion and the lower support portion are substantially planar. In yet another embodiment, the upper support portion and the lower support portion are triangular in shape. In one embodiment, a length of the one or more posts is adjustable such that a distance between the upper support portion and the lower support portion is adjustable.

In another embodiment, the cutout includes a middle circular portion and a projection opening extending from the middle circular portion such that the cutout conforms to a shape of the handle of the multiport valve.

In a second aspect, a valve tool for servicing a multiport valve having a handle and further having a spring located between a rotor and a lid of the multiport valve, the valve tool including: an upper support portion including a cutout shaped to receive at least a portion of the handle of the multiport valve therethrough; an opposing lower support portion; one or more posts located between the upper support portion and the lower support portion; a press located on the lower support portion, the press shaped to contact one of the rotor and lid of the multiport valve. The press urges the rotor and the lid of the multiport valve together to compress the spring between the rotor and the lid of the multiport valve.

In one embodiment, the one or more posts have a length such that the upper support portion is spaced apart from the lower support portion such that the multiport valve may fit between the upper support portion and the lower support portion. In another embodiment, the cutout includes a middle circular portion and a projection opening extending from the middle circular portion such that the cutout conforms to a shape of the handle of the multiport valve. In yet another embodiment, the upper support portion and the lower support portion are substantially planar.

In a third aspect, a valve tool for servicing a multiport valve having a handle and further having a spring located between a rotor and a lid of the multiport valve includes: an upper support portion including a cutout shaped to receive at least a portion of the handle of the multiport valve therethrough, the cutout having a middle circular portion and a projection opening extending from the middle circular portion such that the cutout conforms to a shape of the handle of the multiport valve; an opposing lower support portion; one or more posts located between the upper support portion and the lower support portion; and a press located on the lower support portion, the press shaped to contact one of the rotor and lid of the multiport valve. The press urges the rotor and the lid of the multiport valve together to compress the spring between the rotor and the lid of the multiport valve.

In one embodiment, the upper support portion and the lower support portion are substantially planar. In another embodiment, the one or more posts have a length such that the upper support portion is spaced apart from the lower support portion such that the multiport valve may fit between the upper support portion and the lower support portion.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
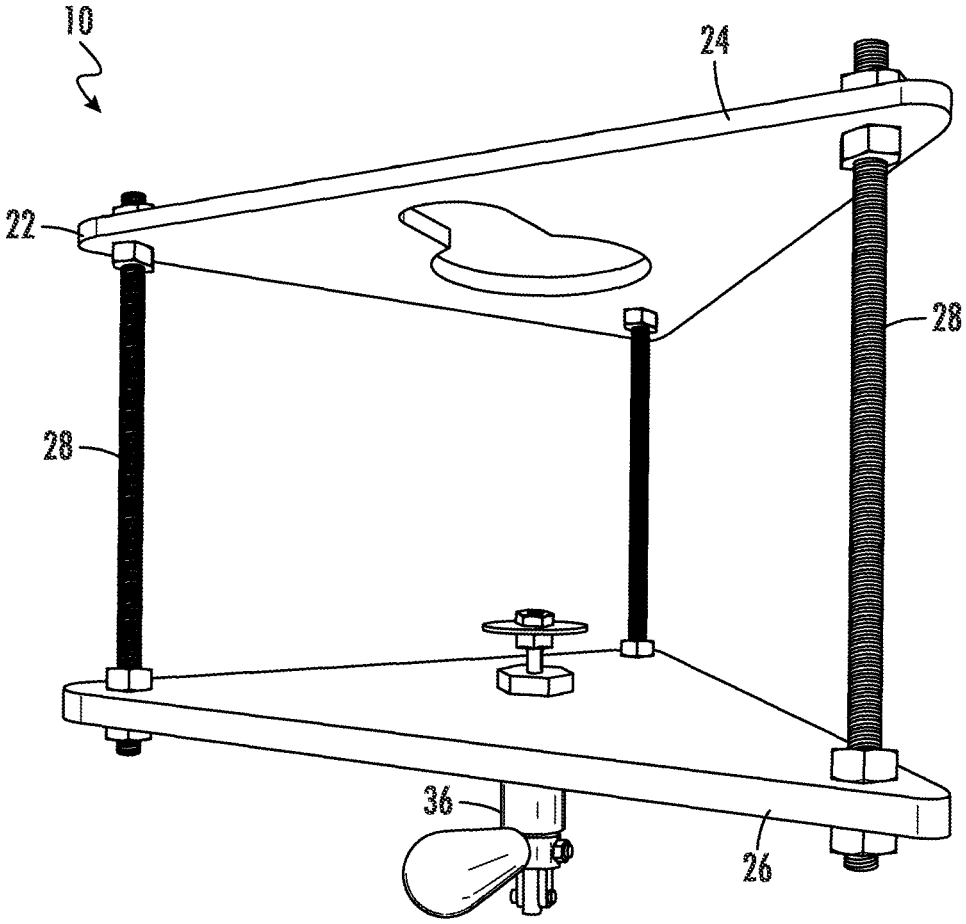
FIG. 1 shows a side view of a valve tool according to one embodiment of the present disclosure.

FIG. 1 shows a basic embodiment of a valve tool 10 for aiding in disassembly of a valve 12. The valve tool 10 is configured to compress a spring 13 of the valve 12 located between a rotor 14 and a lid 16 of the valve 12 such that a pin 18 installed through a handle 20 of the valve 12 may be removed. When the pin 18 is removed, the rotor 14 and lid 16 of the valve may be separated such that components of the valve 12 may be repaired and/or replaced.

The valve tool 10 described herein is preferably adapted for use with a multi-port valve commonly used in association with swimming pools. However, it is also understood that embodiments of the valve tool 10 described herein may be used with other various types of valves and particularly those that may require portions of the valve to be compressed for disassembly, service, or installation.

Referring again to FIG. 1, the valve tool 10 preferably includes a tool body 22 for supporting the valve 12 on the valve tool 10 during assembly and disassembly. The tool body 22 preferably includes an upper support 24 and an opposing lower support 26. The upper support 24 and the lower support 26 are spaced apart such that the valve 12 may fit between the upper support 24 and the lower support 26. The upper support 24 and the lower support 26 are preferably substantially planar and are triangular in shape, as shown in the figures. However, it is also understood that the upper support 24 and the lower support 26 may be provided in other various suitable shapes, such as rectangular or circular shapes.

The upper support 24 and the lower support 26 are preferably fixed relative to one another, such as with a plurality of posts 28 extending between the upper support 24 and the lower support 26. The plurality of posts 28 are preferably spaced apart around edges of the upper support 24 and the lower support 26 such that the valve 12 may be inserted between the upper support 24 and the lower support 26 without removal or movement of either of the upper support 24 or the lower support 26. In one embodiment, a distance between the upper support 24 and the lower support 26 is adjustable at the plurality of posts 28, such as by providing threading on the plurality of posts 28.

Figure 2:
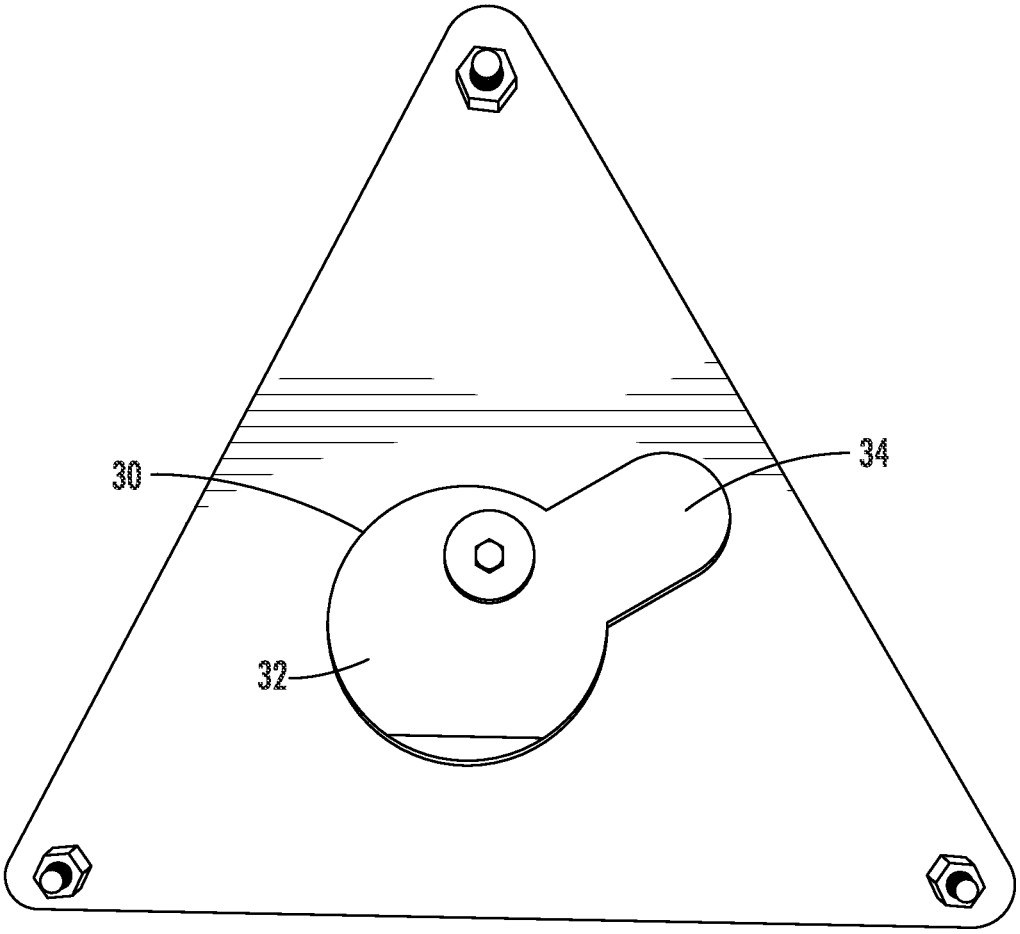
FIG. 2 shows a top view of a valve tool according to one embodiment of the present disclosure.

The upper support 24 includes a cutout 30 (FIG. 2) formed therein for receiving at least a portion of the valve 12 through the upper support 24. The cutout 30 is preferably shaped to receive the handle 20 of the valve 12 through the upper support 24 such that the lid 16 of the valve 12 sits substantially flush with a surface of the upper support 24. The cutout 30 preferably includes a circular middle portion 32 and a projection opening 34 extending from a side of the middle portion 32. The cutout is shaped such that the pin 18 may be removed from the valve 12 when the valve 12 is compressed in the valve tool 10 as discussed in greater detail below.

Figure 3:
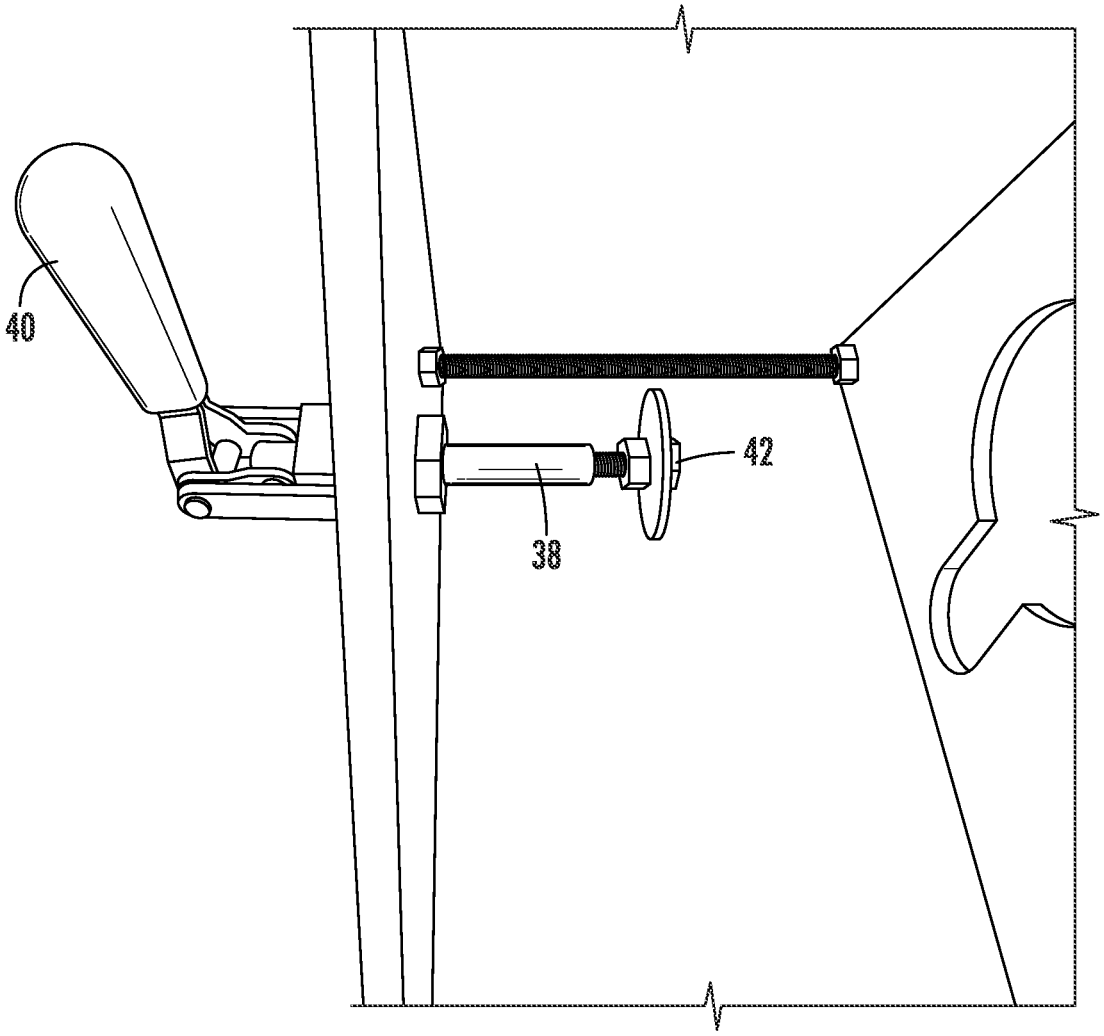
FIG. 3 shows a close-up view of a press of a valve tool according to one embodiment of the present disclosure.
Figure 9:
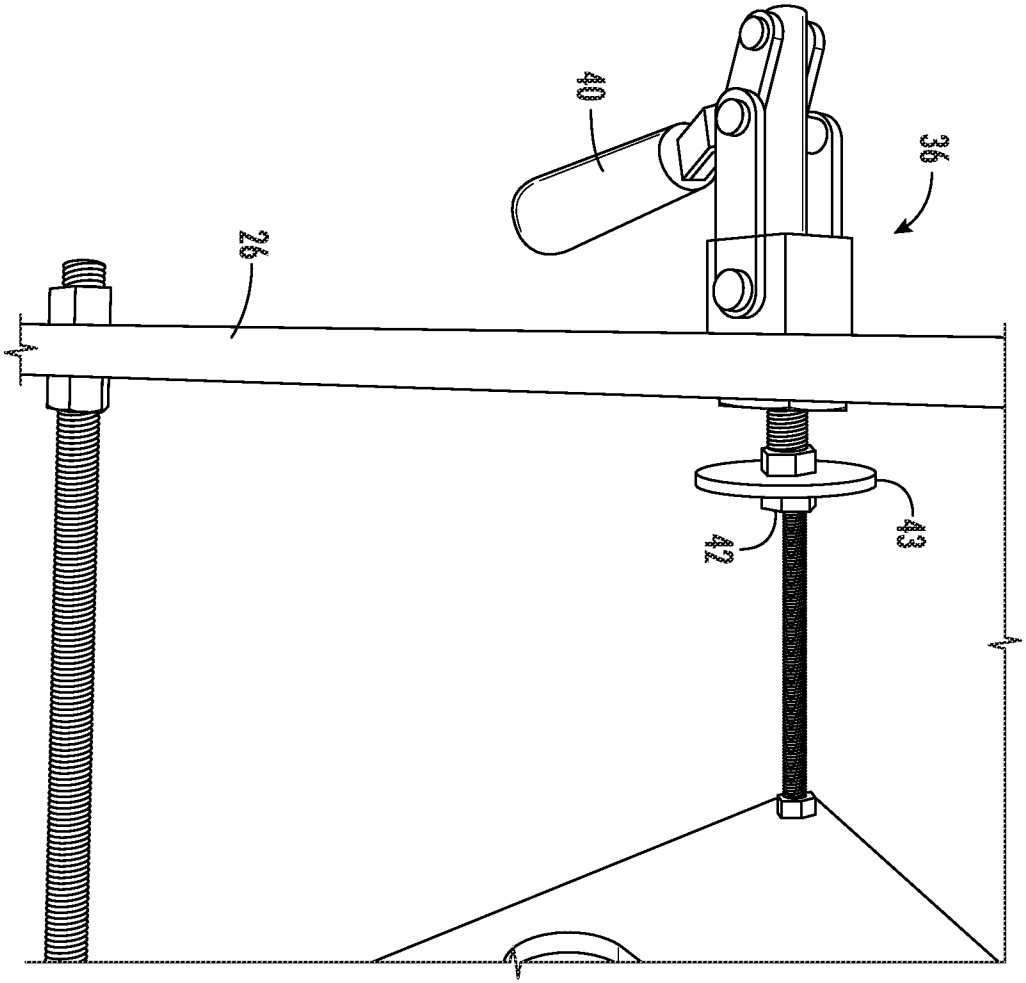
FIG. 9 shows a side view of a valve tool according to one embodiment of the present disclosure.
Figure 10:
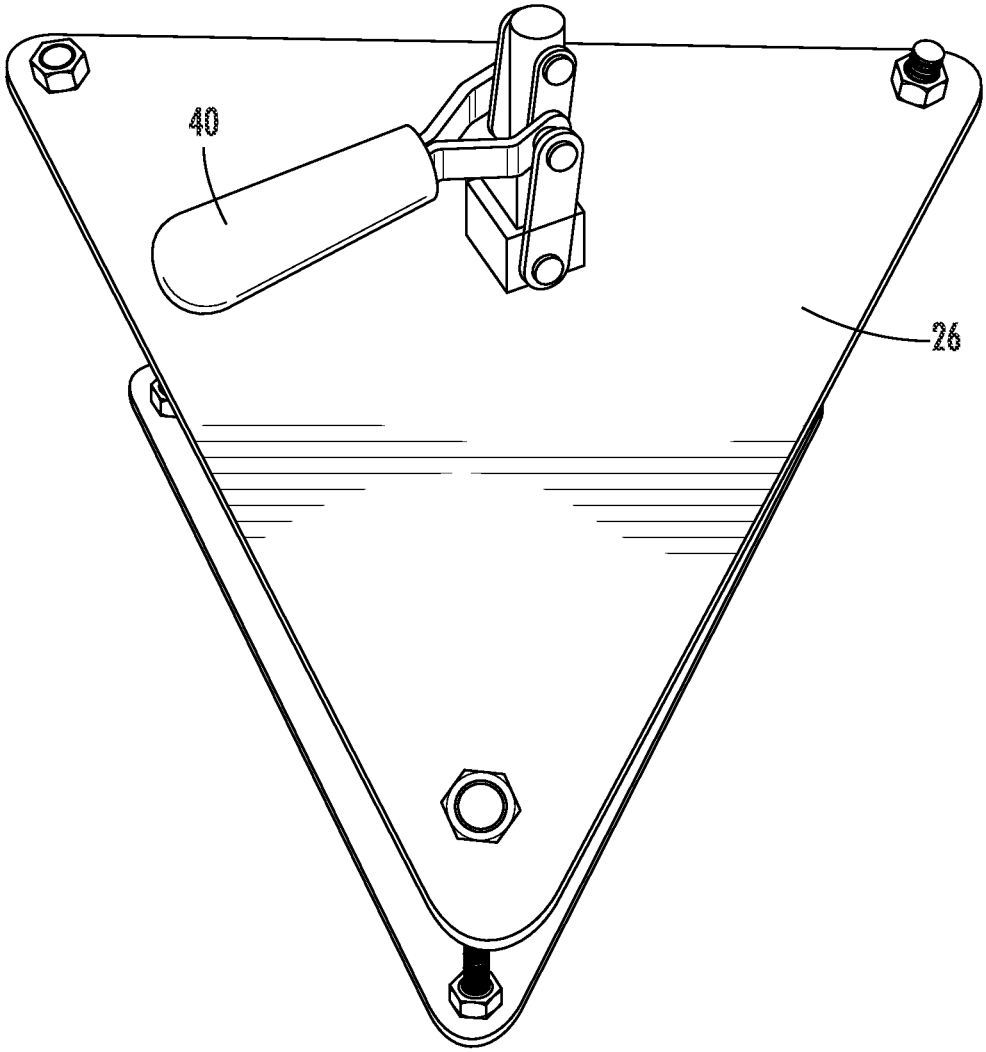
FIG. 10 shows a bottom view of a valve tool according to one embodiment of the present disclosure.
Figure 11:
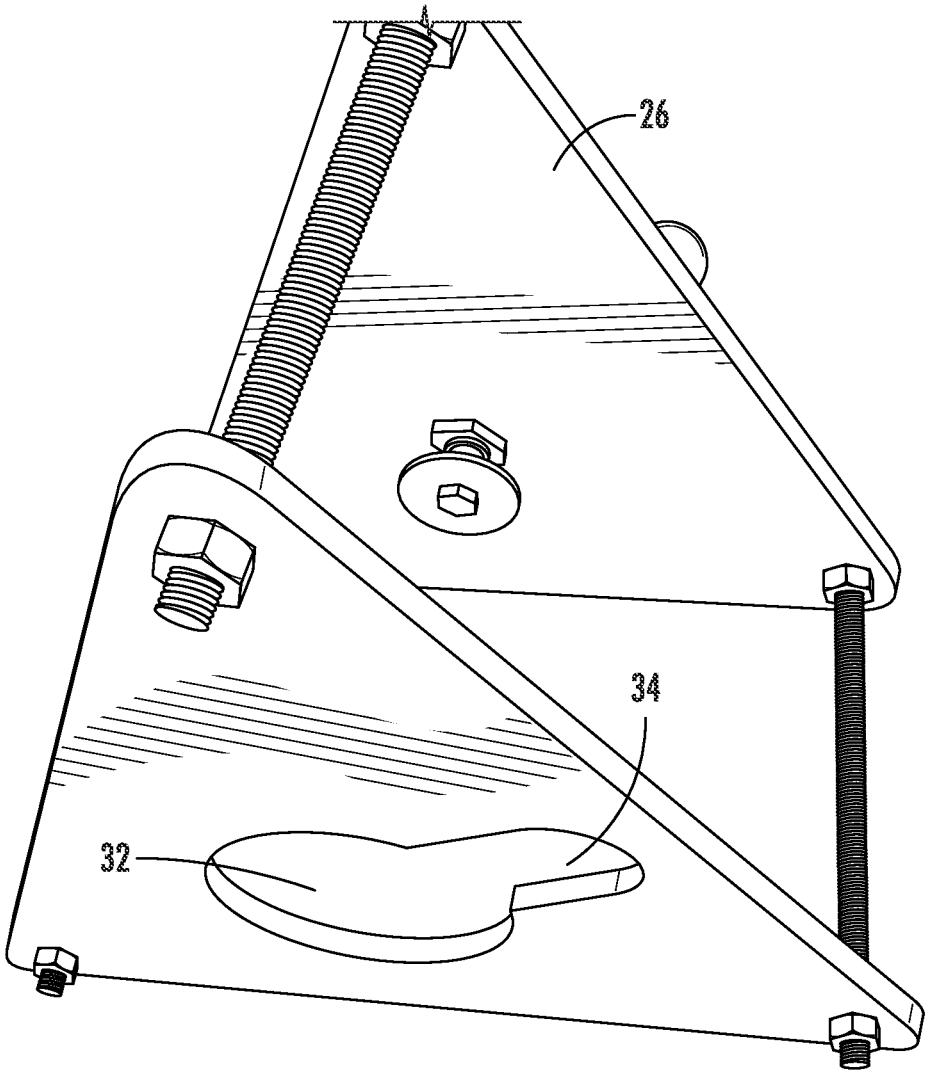
FIG. 11 shows a perspective top view of a valve tool according to one embodiment of the present disclosure.
Figure 12:
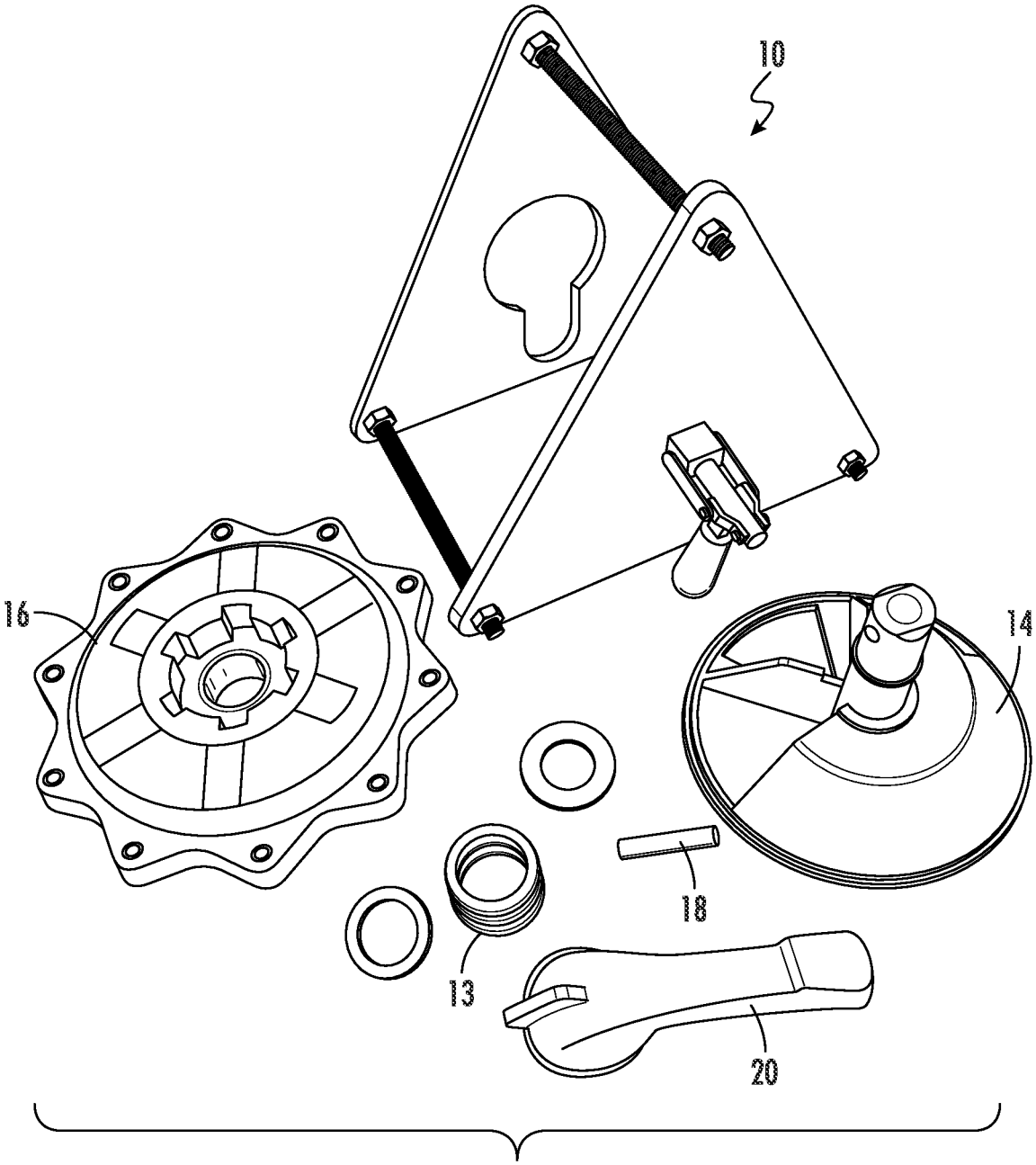
FIG. 12 shows an exploded view of a multi-port valve and valve tool according to one embodiment of the present disclosure.

Referring again to FIG. 1, the lower support 26 includes a press 36 located thereon for releasably engaging and compressing the valve 12 within the valve tool 10 as discussed below. As shown in the figures, the press 36 preferably includes a cylinder 38 (FIG. 3) that is movably located through the lower support 26. A handle 40 is located at a first end of the cylinder 38 for urging the cylinder 38 towards the valve 12 when the valve 12 is located on the valve tool 10. A press end 42 is located at a second end of the cylinder 38 and is shaped to contact the rotor 14 of the valve 12. In one embodiment, the press end 42 is shaped to fit within a bore formed at a center of a bottom of the rotor 14 to maintain the valve 12 in alignment on the valve tool 10. The press end 42 further preferably includes a flanged portion 43 (FIG. 9) that contacts a bottom surface of the rotor 14 when the press end 42 contacts the rotor 14 as described in detail below.

The press 36 is preferably movable between an engaged position and disengaged position. In the disengaged position, the handle 40 is oriented such that the cylinder 38 is retracted and the press end 42 is not urging the valve 12 against the upper support 24. In the engaged position, the handle 40 is manipulated such that the cylinder 38 urges the press end 42 into contact with the bottom of the rotor 14, securing the valve 10 between the press end 36 and the upper support 24. When the press is in the engaged position, the handle 40 is preferably locked such that the press 36 remains in the engaged position during removal of the handle 20 from the valve 12 as discussed in greater detail below.

Figure 4:
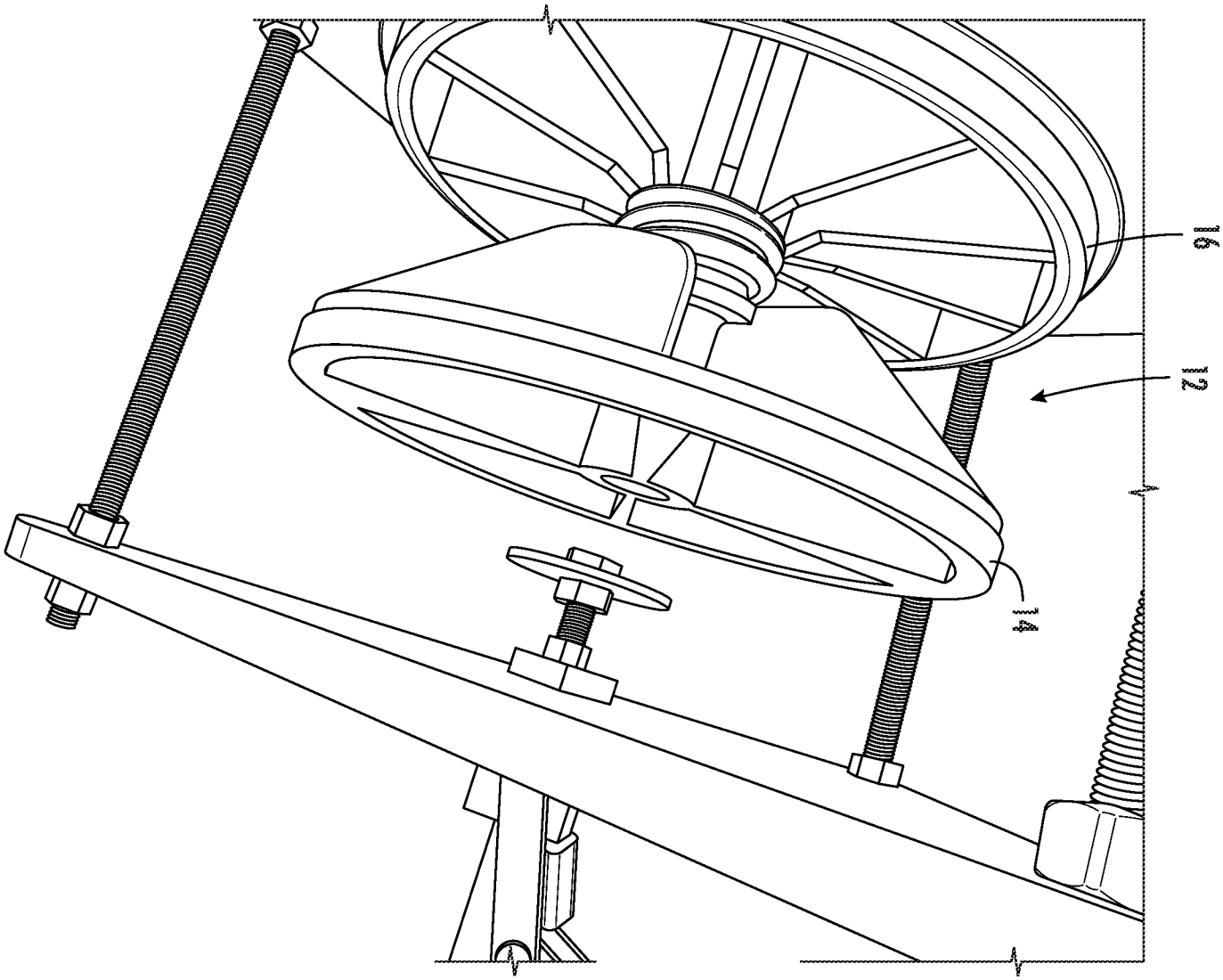
FIG. 4 shows a close-up view of a press engaging a bottom of a valve according to one embodiment of the present disclosure.

In operation, the valve tool 10 aids in assembly and disassembly of the valve 12 by compressing a spring of the valve to allow for removal and installation of the handle 20 relative to the rotor 14 and the lid 16. The valve 12 is placed between the upper support 24 and the lower support 26. The valve 12 is oriented such that the handle 20 is located through and aligned with the cutout 30 of the upper support 24. The press end 42 is aligned with a center of the bottom of the rotor 14 (FIG. 4) while the press 36 is in the disengaged position.

Figure 5:
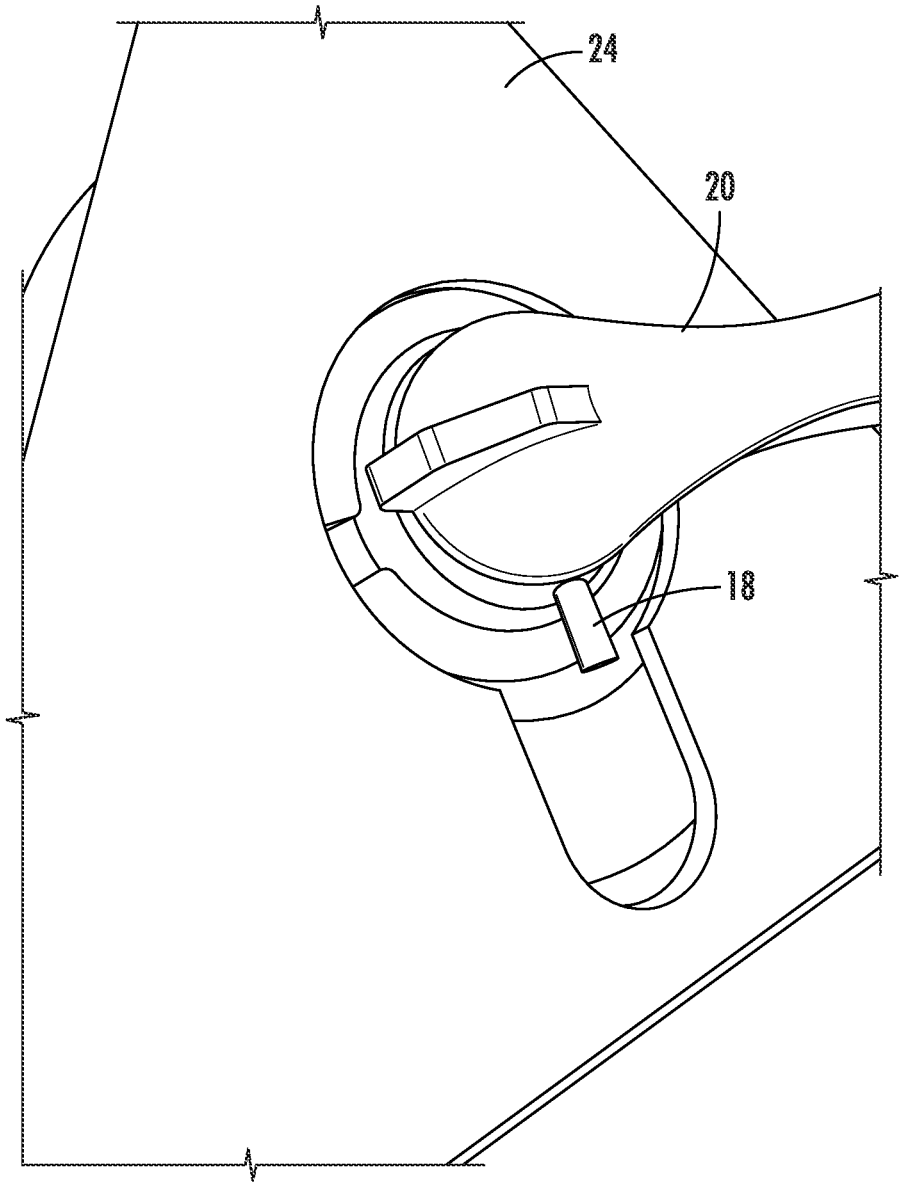
FIG. 5 shows a close-up top view of a valve tool according to one embodiment of the present disclosure.
Figure 6:
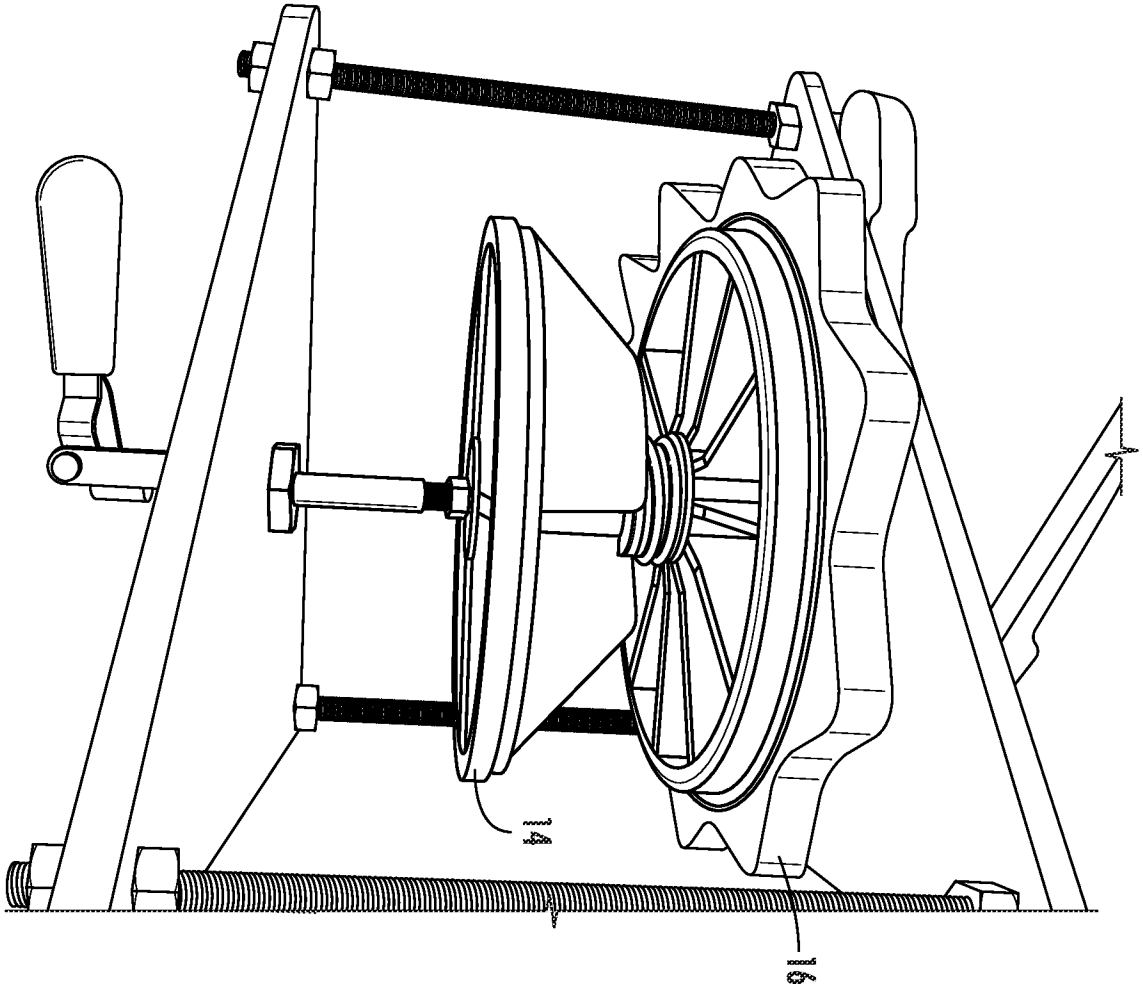
FIGS. 6-7 show a side view of a valve tool and valve located therein according to one embodiment of the present disclosure.
Figure 7:
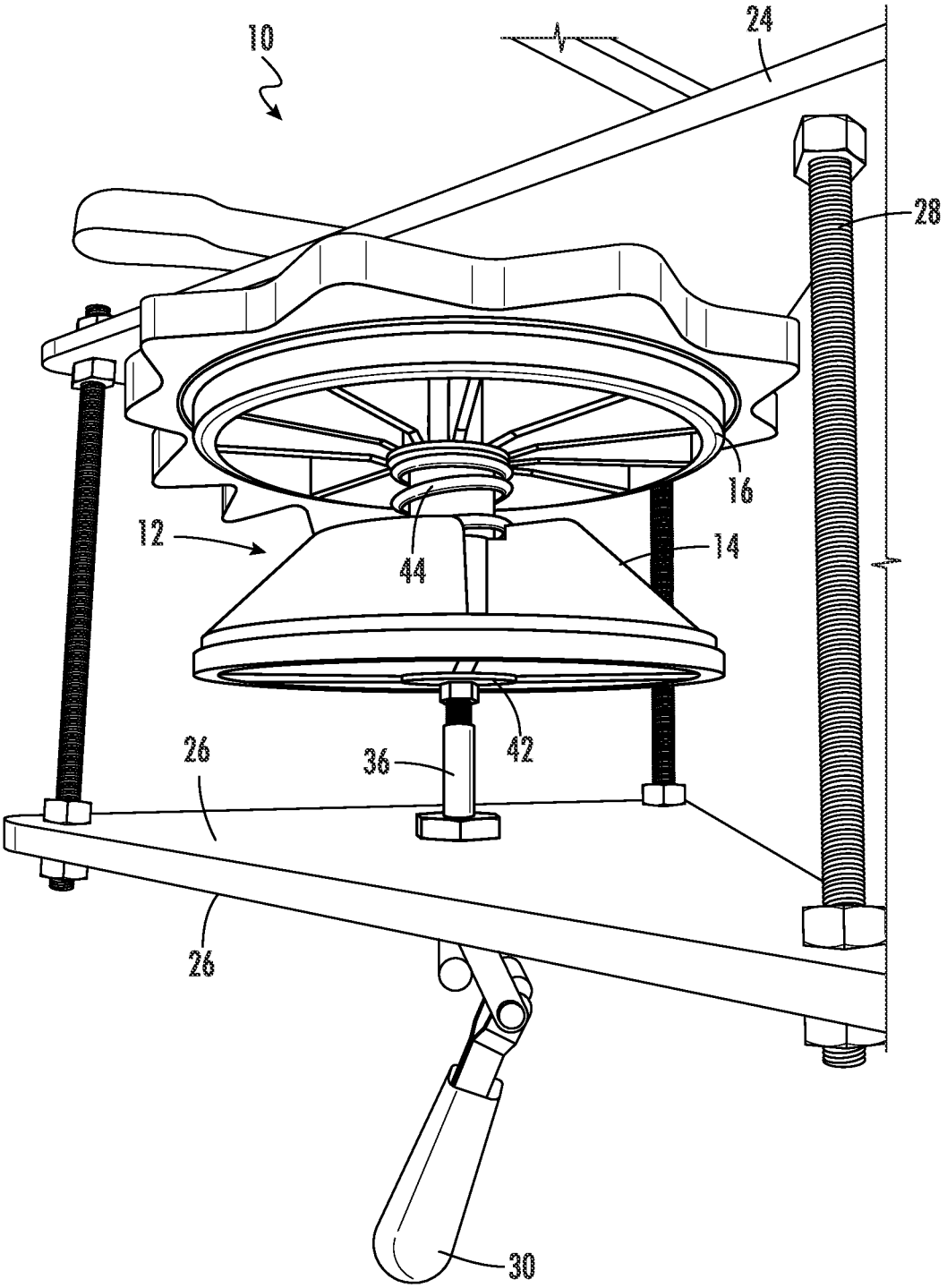
Figure 8:
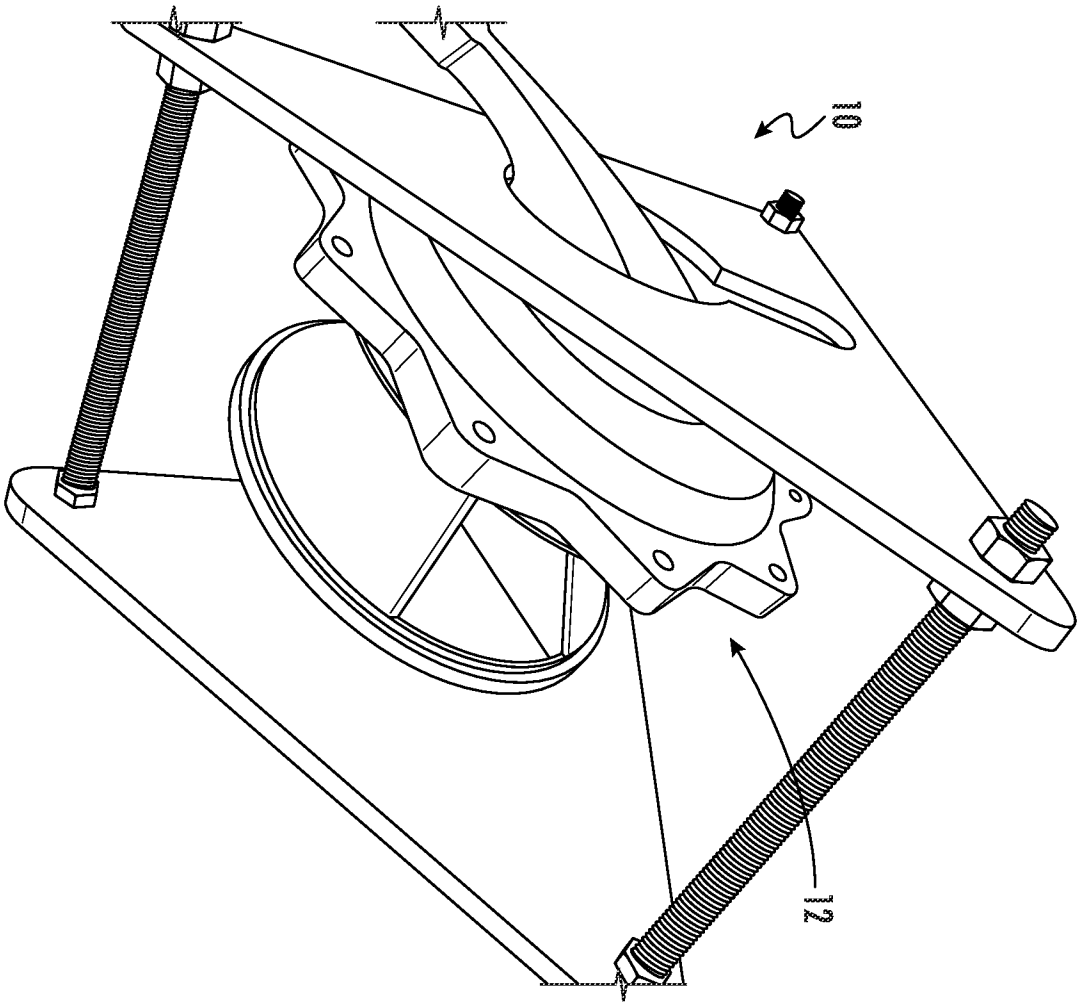
FIG. 8 shows a perspective side view of a valve tool and valve located therein according to one embodiment of the present disclosure.

A user next manipulates the handle 30 of the press 36 such that the press is moved to the engaged position, as shown in FIG. 7. In the engaged position, the press end 42 urges the rotor 14 upwards. The lid 16 is urged against the upper support 24. As the lid 16 is urged against the upper support 24, a spring 44 between the lid 16 and the rotor 14 is compressed. When the spring 44 is compressed, a pin or other fastener located through the handle 20 and securing the handle to the rotor 14 may be removed as shown in FIG. 5.

Embodiments of the valve tool 10 described herein advantageously enable a user to compress the valve 12 such that the handle 20 of the valve 12 may be removed. When the handle 20 is removed, the valve 12 may be disassembled for replacement of components of the valve 12. Further, embodiments of the valve tool 10 disclosed herein may be suitable for reassembly of the valve 12, such as by compressing a spring of the valve 12 to allow the handle 20 to be reinstalled on the rotor 14.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A valve tool for servicing a multiport valve having a handle and further having a spring located between a rotor and a lid of the multiport valve, the valve tool comprising:

an upper support portion including a cutout shaped to receive at least a portion of the handle of the multiport valve therethrough, wherein the cutout is an elongated cutout defined by a closed shape, the cutout having a middle circular portion and a projection opening extending from the middle circular portion such that the cutout conforms to a shape of the handle of the multiport valve;

an opposing lower support portion;

a press located on the lower support portion, the press shaped to contact one of the rotor and the lid of the multiport valve;

wherein the press urges the rotor and the lid of the multiport valve together to compress the spring between the rotor and the lid of the multiport valve.

2. The valve tool of claim 1, the press further including a handle and a press end movable relative to the opposing lower portion of the valve tool, wherein the press end is shaped to contact the rotor of the multiport valve to urge the rotor towards the lid to compress the spring of the multiport valve.

3. The valve tool of claim 1, further comprising one or more posts extending between the upper support portion and the lower support portion.

4. The valve tool of claim 3, wherein the one or more posts have a length such that the upper support portion is spaced apart from the lower support portion such that the multiport valve may fit between the upper support portion and the lower support portion.

5. The valve tool of claim 4, wherein the upper support portion and the lower support portion are substantially planar.

6. The valve tool of claim 5, wherein the upper support portion and the lower support portion are triangular in shape.

7. The valve tool of claim 3, wherein a length of the one or more posts is adjustable such that a distance between the upper support portion and the lower support portion is adjustable.

8. A valve tool for servicing a multiport valve having a handle and further having a spring located between a rotor and a lid of the multiport valve, the valve tool comprising:

an upper support portion including a cutout shaped to receive at least a portion of the handle of the multiport valve therethrough, wherein the cutout is an elongated cutout defined by a closed shape, the cutout having a middle circular portion and a projection opening extending from the middle portion such that the cutout conforms to a shape of the handle of the multiport valve;

an opposing lower support portion;

one or more posts located between the upper support portion and the lower support portion;

a press located on the lower support portion, the press shaped to contact one of the rotor and the lid of the multiport valve;

wherein the press urges the rotor and the lid of the multiport valve together to compress the spring between the rotor and the lid of the multiport valve.

9. The valve tool of claim 8, wherein the one or more posts have a length such that the upper support portion is spaced apart from the lower support portion such that the multiport valve may fit between the upper support portion and the lower support portion.

10. The valve tool of claim 8, wherein the upper support portion and the lower support portion are substantially planar.

11. A valve tool for servicing a multiport valve having a handle and further having a spring located between a rotor and a lid of the multiport valve, the valve tool comprising:

an upper support portion including a cutout shaped to receive at least a portion of the handle of the multiport valve therethrough, the cutout being defined by a closed shape and having a middle circular portion and a projection opening extending from the middle circular portion such that the cutout conforms to a shape of the handle of the multiport valve;

an opposing lower support portion;

one or more posts located between the upper support portion and the lower support portion;

a press located on the lower support portion, the press shaped to contact one of the rotor and the lid of the multiport valve;

wherein the press urges the rotor and the lid of the multiport valve together to compress the spring between the rotor and the lid of the multiport valve.

12. The valve tool of claim 11, wherein the upper support portion and the lower support portion are substantially planar.

13. The valve tool of claim 11, wherein the one or more posts have a length such that the upper support portion is spaced apart from the lower support portion such that the multiport valve may fit between the upper support portion and the lower support portion.

* * * * *